United States Patent [19]

Nakamura

[11] 4,404,932

[45] Sep. 20, 1983

[54] PREHEATING SYSTEM FOR DIESEL ENGINES

[75] Inventor: Tadao Nakamura, Oyama, Japan

[73] Assignee: Kabushiki Kaisha Komatsu Seisakusho, Tokyo, Japan

[21] Appl. No.: 392,697

[22] Filed: Jun. 28, 1982

[30] Foreign Application Priority Data

| | | | |
|---|---|---|---|
| Jun. 29, 1981 | [JP] | Japan | 56-95112 |
| Mar. 26, 1982 | [JP] | Japan | 57-41920 |
| Mar. 31, 1982 | [JP] | Japan | 57-44979 |

[51] Int. Cl.[3] ..... F02N 17/00

[52] U.S. Cl. ..... 123/179 H; 123/145 A

[58] Field of Search ..... 123/179 H, 145 A

[56] References Cited

U.S. PATENT DOCUMENTS

| | | | |
|---|---|---|---|
| 3,675,033 | 7/1972 | Richard et al. | 123/179 H |
| 4,075,998 | 2/1978 | Krauss et al. | 123/179 H |
| 4,106,465 | 8/1978 | Bernhardt et al. | 123/179 H |
| 4,221,205 | 9/1980 | Koehler | 123/179 H |
| 4,261,309 | 4/1981 | Biondi | 123/179 H |
| 4,285,307 | 8/1981 | Steinke | 123/179 H |
| 4,318,374 | 3/1982 | Yasuhara | 123/179 H |
| 4,331,109 | 5/1982 | Arnault | 123/179 H |

FOREIGN PATENT DOCUMENTS 56-17725 4/1981 Japan .

*Primary Examiner*—Parshotam S. Lall

*Attorney, Agent, or Firm*—Armstrong, Nikaido, Marmelstein & Kubovcik

[57] ABSTRACT

A preheating system for a diesel engine using an electric heater for heating suction air introduced into a combustion chamber of the diesel engine. A normally-open first relay is disposed in a circuit connecting the heater with a battery. A coil of the first relay is connected with an accessory terminal of an engine key switch through a pushbutton switch. A timer and a normally-open second relay are disposed in another circuit connecting the coil of the first relay with accessory terminal of the engine key switch. Once the pushbutton switch is pressed, the second relay is closed, connecting the coil of the first relay with the accessory terminal through the timer, thereby electrically connecting the heater with the battery. The heater continues to be heated until the timer deenergizes the first relay.

7 Claims, 6 Drawing Figures

PREHEATING SYSTEM FOR DIESEL ENGINES

BACKGROUND OF THE INVENTION

This invention relates to an automatic preheating system for a diesel engine having an electric suction heater employed therein.

The preheating operation of diesel engines with a precombustion chamber by means of a glow-plug has been automated; however, the preheating system for direct fuel injection type diesel engines by means of an electric suction heater seems to be backward in automation.

It is considered that the advancement in the automation of the system for heating diesel engines by means of a glow-plug was mainly attributable to the facts that because the electric current needed for preheating is low, the battery will not be completely discharged even if it is kept as it is until the engine starts after the completion of preheating, and that because the preheating systems employing a glow-plug are employed mostly in passenger cars, which are not subjected to severe vibrations and other restraints, electronic components can be employed easily, and also that drivers of passenger cars have demanded the automation of such a system.

Whilst, it is envisaged that the delay in the automation of the system for heating the direct fuel injection type diesel engines by means of the electric suction heater was attributable to the facts that because the electric suction heater consumes a high electric power it is required to start the engine immediately after the completion of preheating, and that since such a system is mainly employed in construction vehicles which are used frequently under severe vibrating conditions, it is difficult to employ electronic components which tend to fail under such vibratory conditions.

The electric suction heater is connected through the key switch of the engine with the power supply, and the arrangement is made such that when the key switch is turned to its preheating position an electric current will flow through the heater.

However, since if electric current continues to flow through the heater for an extended period of time a various kinds of troubles may occur, the key switch is arranged to be returned by a biasing spring from the preheating position to "off" position in order to prevent the negligence of operator in resetting the key switch once turned to the preheating position to "off" position.

Therefore, it is required for the operator to continuously hold the key switch at the preheating position and such an opeation is very troublesome for him.

In particular, it is a much burden for the operator to hold the key switch at the preheating position by his hand for an extended period of time under a low atmospheric temparature.

SUMMARY OF THE INVENTION

It is therefore an object of the present invention to provide a preheating system for a diesel engine, which automatically preheats suction air once a pushbutton switch is pressed by an operator.

Another object of the present invention is to provide a preheating system for a diesel engine which is simple in construction and inexpensive to manufacture yet can provide an automatic preheating of the suction air.

A further object of the present invention is to provide a preheating system for a diesel engine wherein once the automatic preheating is completed a buzzer is set to sound telling the operator the engine is ready to get started.

In accordance with an aspect of the present invention, there is provided a preheating system for a diesel engine, comprising: an electric power source; key switch means connected with said electric power source, said key switch means having at least first and second output terminals wherein when said key switch means is switched over to the first output terminal, the first output terminal connects with said electric power source and when said key switch means is switched over to the second output terminal, the diesel engine is caused to be started; heater means for heating suction air into the diesel engine, said heater means being selectively connected with and disconnected from said electric power source; a lamp connected with said heater means; first relay means disposed in a circuit between said heater means and said electric power source, said first relay means being normally open and adapted to be closed when excited; a switch disposed in a circuit between the first output terminal of said key switch means and said first relay means; timer means connected with said switch for selectively connecting and disconnecting said first relay means with and from the first output terminal of said key switch means; and means for selectively connecting and disconnecting said timer means with and from the first output terminal of said key switch means, said means being connected with said switch and disposed in a circuit between said timer means and the first output terminal of said key switch means.

The means for selectively connecting and disconnecting the timer means with and from the first output terminal of the key switch means may be either a relay or a thyristor. In one of the preferred embodiments, a buzzer may be provided in the system for telling the operator that the preheating of the engine has been completed.

The above and other objects, features and advantages of the present invention will be readily apparent from the following description taken in conjunction with the accompanying drawings.

DESCRIPTION OF THE PREFERRED EMBODIMENTS

The present invention will now be described by way of example only with reference to the accompanying drawings.

Figure 1:
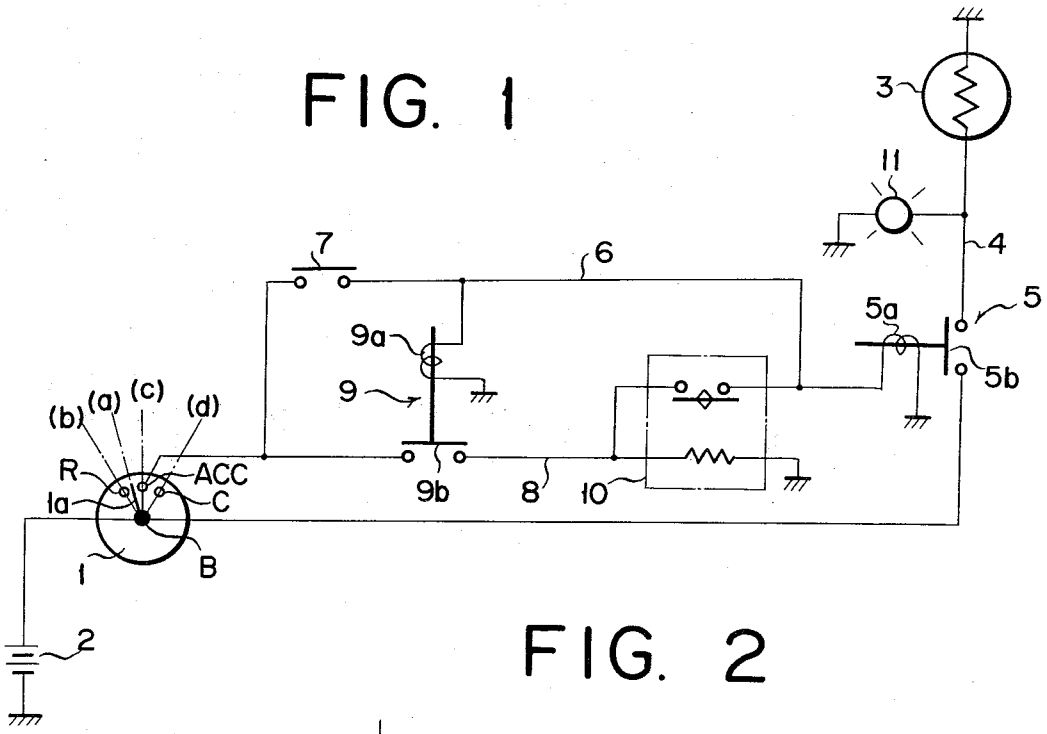
FIG. 1 is an electric circuit diagram of one of the embodiments of preheating system for a diesel engine according to the present invention.

Referring to FIG. 1, there is shown an engine key switch 1 which comprises an input terminal B connected with the positive terminal of a battery 2, a preheating terminal R, an accessory terminal Acc, a starting terminal C, and a contact 1*a* adapted to connect the input terminal B with each of the terminals R, Acc and C and which is arranged to be switched over to any of a turn-off position (a), a preheating position (b), an accessory position (c) and a starting position (d).

In the drawings, reference numeral 3 denotes an electric heater. The electric heater 3 has a circuit 4 which includes a normally-open first relay 5. The circuit 4 is connected through the first relay 5 with the input terminal B of the key switch 1. The accessory terminal Acc of the engine key switch 1 is connected through a first circuit 6 with a coil 5*a* of the first relay 5. the first circuit 6 includes a push button switch 7.

Figure 2:
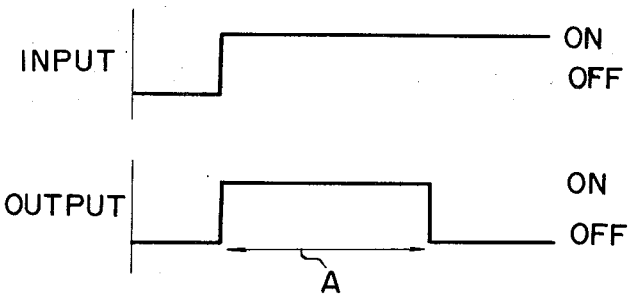
FIG. 2 is a diagram showing characteristics of a bimetal timer employed in the embodiment of FIG. 1.

The accessory terminal Acc of the engine key switch 1 is connected through a second circuit 8 with the coil 5*a* of the first relay 5. The second circuit 8 includes a normally-open second relay 9 and a timer 10 such as a bimetal timer. The second relay 9 has a coil 9*a* connected with the first circuit 6. Reference numeral 11 denotes a lamp. The bimetal timer 10 is adapted to be rendered operative as shown in FIG. 2, and its operative range "A" varies depending on the temperature and voltage applied thereto.

Thus, when the push button switch 7 is depressed, an electric current will flow through the first circuit 6 thus energizing the coil 5*a* of the first relay 5 to close a contact 5*b* and commence preheating. At the same time, the lamp 11 is lighted.

At that time, the coil 9*a* of the second relay 9 is energized to close the contact 9*b* of the second relay 9 and an electric current flows through the holding circuit of the second relay 9 so that the preheating can be continued even if the push button switch 7 is released.

After the lapse of preset definite time, and upon completion of the preheating, the electric current flow through the second circuit 8 will be interrupted by the action of the bimetal timer 10.

Although, upon the completion of preheating, the key switch 1 is switched over to the start position (d) to start the engine of the vehicle, there have selectively been employed two types of key switches in vehicles; one is of the type that when the key switch 1 is switched over to the start position (d) the Acc terminal is turned off and the other is of the type that even when the key switch 1 is changed over to the start position the Acc terminal is not turned off.

In case of the switch of the type that the accessory terminal Acc is turned off when the key switch 1 is turned to its start position (d), the preheating circuit will be disconnected thus resetting the circuit completely to the initial condition and so there is no problem.

However, in case of the switch of the type that the accessory terminal Acc is kep on even if the key switch 1 is turned to its start position, the preheating is continued until the bimetal timer 10 becomes operative. This feature is not preferred to some kinds of machines.

Figure 3:
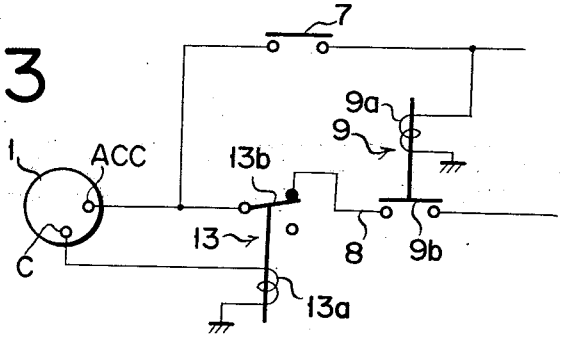
FIG. 3 is a circuit diagram of a part of another embodiment of the present invention with omitted portions being identical to FIG. 1.

To eliminate such a disadvantage, it is only necessary, as shown in FIG. 3, to provide a normally-closed third relay 13 in the second circuit 8 and connect a coil 13*a* of the third relay 13 with the starting terminal C of the key switch 1. When the key switch 1 is turned to its start position (d), the coil 13*a* is energized to open a contact 13*b*. As a result, the entire circuit will be returned to its initial condition.

Figure 4:
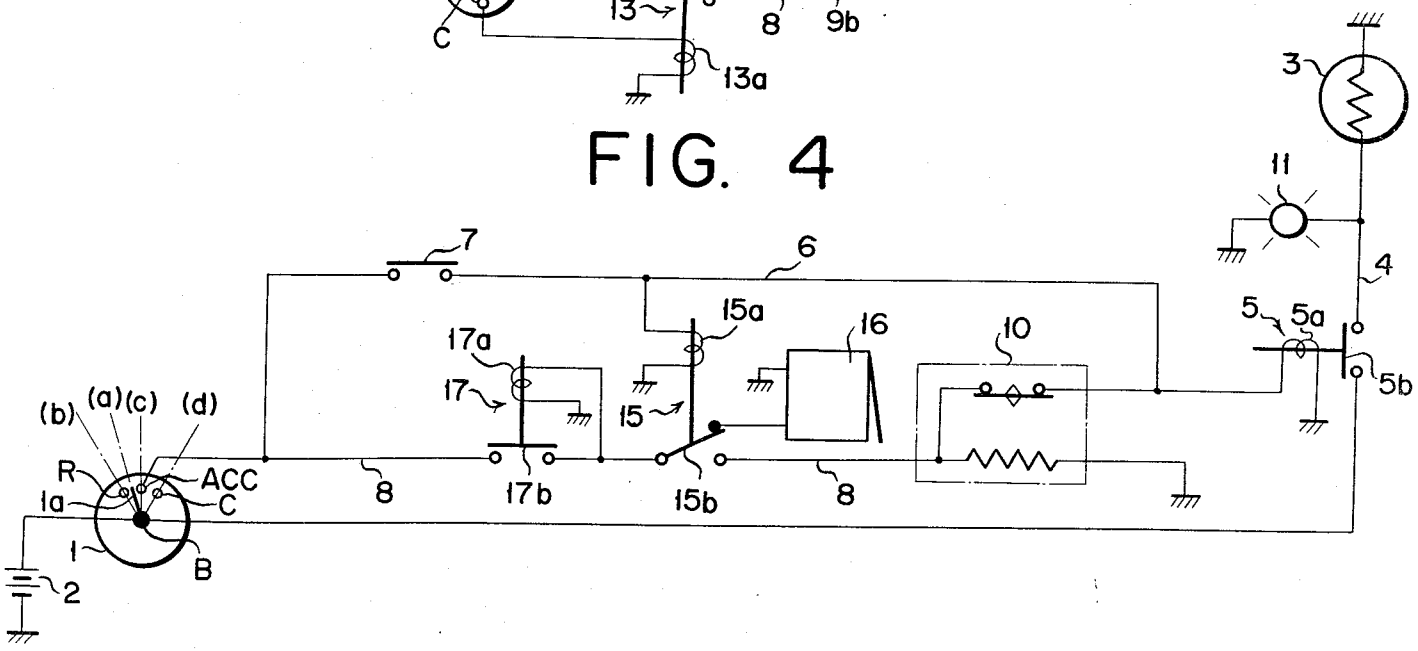
FIG. 4 is an electric circuit in each instance of still another embodiment of the present invention.

Referring to FIG. 4, there is shown a second embodiment of the present invention. The construction of the electric circuit of this embodiment is similar to that of the aforementioned first embodiment, and so only different constructions of this embodiment from the first one will be described below.

A coil 15*a* of a second relay 15 having a change-over contact 15*b* is connected with the first circuit 6. Reference numeral 16 denotes a buzzer with which the change-over contact 15*b* is normally connected. The second circuit 8 includes a normally-open third relay 17.

The operation of the electric circuit system of this embodiment is described below.

When the key switch 1 is changed over to the position of the accessory terminal Acc, the terminal Acc is turned on. Subsequently, the push button switch 7 is depressed for a short time and then released. When the switch 7 is depressed, the contact 5*b* of the first relay 5 is closed and the circuit 4 is connected with the input terminal B of the key switch 1 so that an electric current flows through an electric suction heater 3 and at the same time the lamp 11 is illuminated. At the same time, the coil 15*a* of the second relay 15 is energized to thereby change over the contact 15*b*. As a result, a coil 17*a* of a third relay 17 is energized through the second relay 15 so as to close the contact 17*b* and to allow an electric current to flow through the bimetal timer 10. After the lapse of a definite time, the output of the bimetal timer 10 is turned off so as to disconnect the first relay 5 and change over the second relay 15. Therefore upon completion of the preheating, the lamp 11 is turned off and the buzzer 16 is activated giving an alarm.

Subsequently, the key switch 1 is turned to the starting position (d) to start the engine.

When the key switch 1 has been turned to the starting position, the accessory terminal Acc is usually turned off so as to disconnect the third relay 17 and deactivate the buzzer 16.

In case of the switch of the type that even when the key switch 1 is turned to its starting position the accessory terminal Acc is not turned off, the buzzer 16 may be deactivated by any of the following procedures.

(i) Turn the key switch 1 to "off" position before turning it to the starting position.

(ii) Provide a relay having a normally-closed contact as shown in FIG. 3 in the circuit 8, and turn the key switch 1 to the starting position (the terminal C is turned on) to open the relay and interrupt the flow of electric current through the buzzer 16.

Figure 5:
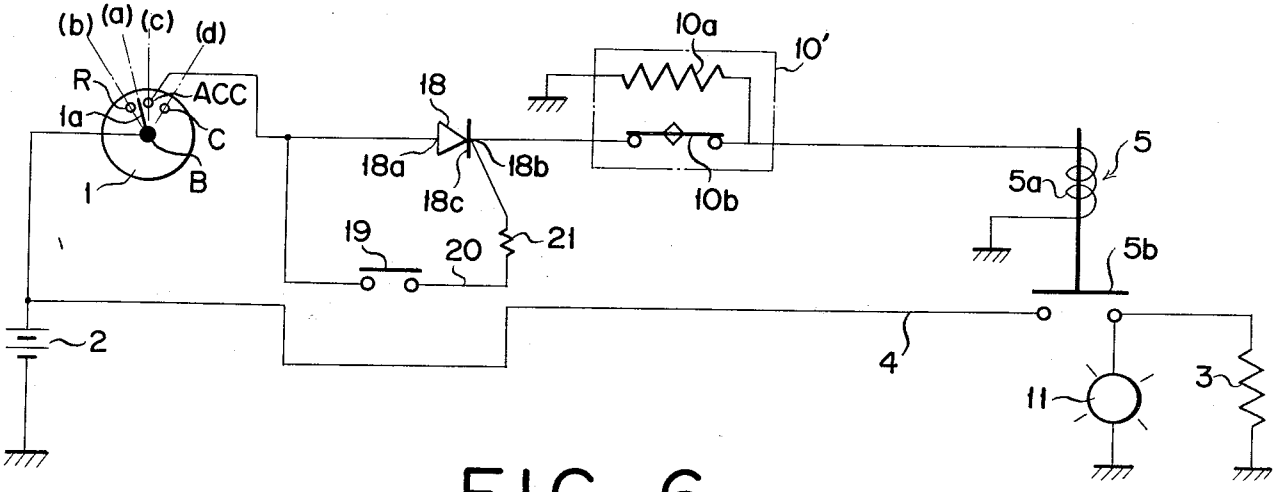
FIG. 5 is an electric circuit in each instance of further embodiment of the present invention.

Referring to FIG. 5, there is illustrated a third embodiment of the present invention in which a thyristor is employed in place of the relay used in the first and second embodiments described above.

In the electric circuit of this embodiment, the accessory terminal Acc is connected with a thyristor 18, a timer 10' of bimetal type and coil 5*a* of the relay 5. The anode and gate of the thyristor 18 are short-circuited by a circuit 20 including a push button switch 19.

The relay 5 has the normally-open contact 5*b* which serves to connect and disconnect the circuit 4 connecting the electric suction heater 3 and the lamp 11 with the positive terminal of the battery 2.

Reference numeral 21 denotes a resistor provided in the circuit 20.

The above-mentioned thyristor 18 is a kind of semiconductor device in which electric current is allowed to flow only from the anode 18*a* to the cathode 18*b*. In this thyristor 18, when no electric current flows through the gate 18*c*, electric current will not flow from the anode 18*a* to the cathode 18*b*, but if electric current once begins to flow through the gate 18c, electric current will continue to flow from the anode 18a to the cathode 18b even when the gate current is interrupted. Further, when the electric current flow from the anode 18a to the cathode 18b is interrupted, the initial condition is attained again. Therefore, even if a voltage is applied across the anode 18a and cathode 18b, electric current will not flow from the anode 18a to the cathode 18b unless the gate 18c is rendered conductive.

Figure 6:
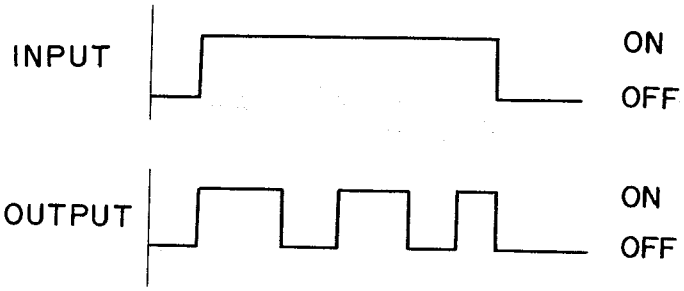
FIG. 6 is a diagram showing characteristics of a bimetal timer employed in the embodiment of FIG. 5.

The timer 10' of bimetal type comprises a heat-generating resistor 10a and a bimetal 10b which serves, when heated, to disconnect or interrupt the circuit. The time for which the bimetal 10b interrupts the circuit may be controlled as desired by changing the number of turns of the coil (or resistor) 10a. FIG. 6 shows the characteristics of the timer 10'.

The operation of the electric circuit system of this embodiment will be described below.

When the key switch 1 is changed over to the accessory position (c), the accessory terminal Acc and the terminal B are interconnected.

When, under such a state, the push button switch 19 is depressed, an electric current controlled by the resistor 21 will flow through the gate 18c of the thyristor 18 to thereby allow the electric current to flow from the anode 18a to the cathode 18b so that the coil 5a of the relay 5 is energized to close its normally-open contact 5b so as to allow electric current to pass through the heater 3 and the lamp 11 thereby simultaneously carrying out the preheating operation and indicating thereof by the lamp 11 that preheating is being conducted.

Under such a condition, even when the push button switch 19 is released, electric current will continue to flow from the anode 18a of the thyristor 18 to the cathode 18b thereof. However, when a time preset by the timer 10' of bimetal type has passed, the bimetal 10b which is subjected to the heat generated by the resistor 10a will interrupt the circuit and the thyristor 18 will be returned to its initial condition to thereby interrupt the electric current flow through the coil 5a of the relay 5 so that the normally-open contact 5b is opened so as to inhibit the electric current flow from the battery 2 to the heater 3 and the lamp 11 and complete the preheating.

As can be seen from the foregoing description, it is possible to allow an electric current to flow through the heater 3 for a predetermined time to conduct preheating only by depressing once the push button switch 7 or 19.

It is to be understood that the foregoing description is merely illustrative of preferred embodiments of the invention, and that the scope of the invention is not to be limited thereto, but is to be determined by the scope of the appended claims.

What is claimed is:

1. A preheating system for a diesel engine of the direct fuel injection type, comprising:

connection means for an electric power source;

key switch means connected with said connection means for said electric power source, said key switch means having at least first and second output terminals wherein, when said key switch means is switched over to the first output terminal, the first output terminal connects with said connection means for said electric power source and when said key switch means is switched over to the second output terminal, the diesel engine is caused to be started;

electric suction heater means for heating suction air into the diesel engine, said electric suction heater means being selectively connected with and disconnected from said connection means for said electric power source;

a lamp connected with said heater means;

first relay means disposed in a circuit between said electric suction heater means and said connection means for said electric power source, said first relay means being normally-open and adapted to be closed when excited;

a push-button switch disposed in a circuit between the first output terminal of said key switch means and said first relay means;

timer means connected with said push-button switch for selectively connecting and disconnecting said first relay means with and from said first output terminal of said key switch means; and means for selectively connecting and disconnecting said timer means with and from the first output terminal of said key switch means, said means being connected with said push-button switch and disposed in a circuit between said timer means and the first output terminal of said key switch means.

2. A preheating system as recited in claim 1 wherein said last mentioned means comprises second relay means which is normally-open and is adapted to be closed when excited.

3. A preheating system as recited in claim 2 further comprising additional relay means for selectively connecting and disconnecting said second relay means with and from said first output terminal, said additional relay means being connected with said second output terminal and being normally held closed and adapted to be opened when excited.

4. A preheating system as recited in claim 1 further comprising sound generating means and wherein said last mentioned means comprises second relay means connected with said switch and third relay means connected with said switch through said second relay means, said second relay means being normally held to connect said sound generating means with the first output terminal of said key switch means through said third relay means and adapted to disconnect said sound generating means from and connect said timer means with said first output terminal through said third relay means when excited, said third relay means being normally-open and adapted to be closed when excited.

5. A preheating system as recited in claim 4 further comprising additional relay means for selectively connecting and disconnecting said third relay means with and from said first output terminal, said additional relay means being connected with said second output terminal and being normally held closed and adapted to be opened when excited.

6. A preheating system as recited in claim 1 wherein said last mentioned means comprises a thyristor.

7. A preheating system as recited in claim 1, 2, 4 or 6 wherein said timer means comprises a bimetal timer.

* * * * *